US009666364B2

(12) United States Patent
Muto

(10) Patent No.: US 9,666,364 B2
(45) Date of Patent: May 30, 2017

(54) WINDING APPARATUS AND WINDING METHOD

(71) Applicant: NITTOKU ENGINEERING CO., LTD., Saitama (JP)

(72) Inventor: Kenichi Muto, Fukushima (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 245 days.

(21) Appl. No.: 14/558,185

(22) Filed: Dec. 2, 2014

(65) Prior Publication Data

US 2015/0183614 A1 Jul. 2, 2015

(30) Foreign Application Priority Data

Dec. 27, 2013 (JP) ..... 2013-270995

(51) Int. Cl.
*H01F 41/06* (2016.01)
*H01F 41/073* (2016.01)
*H01F 41/088* (2016.01)

(52) U.S. Cl.
CPC ..... *H01F 41/073* (2016.01); *H01F 41/088* (2016.01)

(58) Field of Classification Search
CPC ..... B65H 54/06; B65H 54/08; H01F 41/073; B21C 47/10
See application file for complete search history.

(56) References Cited

U.S. PATENT DOCUMENTS

2009/0057473 A1* 3/2009 Ujiie ..... H02K 15/095 242/433.3

FOREIGN PATENT DOCUMENTS

JP 2002-354762 A 12/2002
JP 3588586 B2 11/2004

* cited by examiner

*Primary Examiner* — Emmanuel M Marcelo
(74) *Attorney, Agent, or Firm* — Rabin & Berdo, P.C.

(57) ABSTRACT

A winding apparatus includes a nozzle that is adapted to rotate about a core along a locus that is inclined relative to a center line of the core, wire material winding members that are adapted to guide a wire material wound via the nozzle to the core, and a core rotating mechanism that is adapted to rotate the core relative to the wire material winding members. The wire material winding members are disposed on either side of the core so as to sandwich a plane that includes both a rotary center of the nozzle and the center line of the core, whereby the wire material winding members extend in a tangential direction to the core such that respective tip ends thereof are oriented in a rotation direction of the core. The wire material is successively wound diagonally around the core.

6 Claims, 15 Drawing Sheets

WINDING APPARATUS AND WINDING METHOD

TECHNICAL FIELD

The present invention relates to a winding apparatus and a winding method for a coil.

BACKGROUND ART

Conventionally, a coil forming a rotor of a small coreless motor must be shaped with a high degree of precision. A method of winding a cylindrical coil by successively winding a wire material diagonally around an outer periphery of a core may be employed as a method of manufacturing this type of coil. A winding apparatus used with this method includes a nozzle that rotates relative to the core while feeding out the wire material, a wire retainer that guides the wire material wound around the core to a predetermined position of the core, and a core rotating mechanism that rotates the core relative to the wire retainer.

In JP3588586B, the present applicant proposed a winding apparatus and a winding method for leading a wire material wound around a wire retainer smoothly to an outer peripheral surface of a core by inclining a locus of a nozzle that rotates relative to the core relative to a center line of the core and, during a process in which the wire retainer guides the wire material to the core, varying a contact angle of the wire retainer relative to the core while keeping the wire retainer in contact with the core.

With this winding apparatus and winding method, the contact angle of the wire retainer relative to the core is varied while keeping the wire retainer in contact with the outer periphery of the core, and therefore the wire material wound around the wire retainer can be encouraged to slide down the surface of the wire retainer and move onto the core. As a result, the wire material is wound around the core in a predetermined position. Thus, winding irregularities in the successively wound wire material such as overlapping and gaps can be prevented.

SUMMARY OF INVENTION

However, with the conventional winding apparatus and winding method described above, in which the contact angle of the wire retainer is varied, the wire retainer is formed in a shape that tapers toward a tip end that contacts the core in order to guide the wire material to a predetermined position of the core.

A wire retainer having this tapered shape is manufactured by sheet metal working. As a result, manufacturing costs are high, and variation is likely to occur in a surface roughness and dimensions of the wire retainer. When the surface roughness increases, an outer surface of the wire material that slides down the surface of the wire retainer may be damaged.

Furthermore, as shown in FIG. 15, with the conventional winding apparatus and winding method described above, tip ends of wire retainers 101, 102, which contact or approach a core 103, are disposed on either side of the core 103 so as to sandwich the core 103 in positions located on a plane H that includes both a rotary center of a nozzle 104 and a center line of the core 103. Therefore, when the nozzle 104 is positioned on or in the vicinity of the plane H including both the rotary center of the nozzle 104 and the center line of the core 103, a wire material 105 fed from the nozzle 104 initially contacts the wire retainers 101, 102, as indicated by solid lines.

The wire material 105 that contacts and is wound around the wire retainers 101, 102 then moves so as to slide along respective surfaces of the wire retainers 101, 102 as the nozzle 104 rotates so that when the nozzle 104 moves away from the plane H, the wire material 105 reaches the tip ends of the wire retainers 101, 102.

Thereafter, the wire retainers 101, 102 must retain the wire material 105 initially wound around the wire retainers 101, 102 on the respective tip ends thereof until the nozzle 104 rotates further such that new wire material 105 is wound around the wire retainers 101, 102.

In other words, with the conventional winding apparatus and winding method described above, although the contact angle of the wire retainers 101, 102 relative to the core 103 can be varied, the wire retainers 101, 102 must retain the initially wound wire material 105 on the tip ends thereof until the nozzle 104 completes a single revolution around the core 103 such that new wire material 105 is wound around the wire retainers 101, 102.

In the conventional winding apparatus and winding method described above, however, the contact angle varies in accordance with a biasing force exerted on the wire retainers 101, 102 by a coil spring 106, making it difficult to adjust the contact angle. Furthermore, when variation occurs in the surface roughness of the wire retainers 101, 102, the initially wound wire material 105 is not always guided to the core 103 at the point where the new wire material 105 is wound, and as a result, a plurality of wire material 105 may be wound around the wire retainers 101, 102 simultaneously.

When a plurality of wire material is wound around the wire retainers 101, 102 simultaneously, the subsequently wound wire material 105 may pass over the initially wound wire material 105 such that the plurality of wire material 105 is guided to the core 103 simultaneously.

As a result, a gap may form between the wire material 105 guided to the core 103 previously and the plurality of wire material 105 guided to the core 103 thereafter, making it difficult to wind the wire material 105 in a sequentially adjacent fashion.

Moreover, the wire retainers 101, 102 are formed in a tapered shape, and therefore, when a plurality of wire material 105 is wound around the wire retainers 101, 102, a length of the wire material 105 wound around the tip end side of the wire retainers 101, 102 decreases while a length of the wire material 105 wound around parts removed from the tip end increases steadily away from the tip end. Hence, when a plurality of wire material 105 is wound around the wire retainers 101, 102, the length of the wire material 105 guided to the core 103 may vary.

Further, in the conventional winding apparatus and winding method described above, when an outer diameter of the wire material 105 is comparatively large, the biasing force exerted on the wire retainers 101, 102 by the coil spring 106 is insufficient, making winding difficult.

Furthermore, it is extremely difficult to adjust the biasing force exerted on the wire retainers 101, 102 by the coil spring 106 in a balanced manner on the basis of the outer diameter of the wire material 105, a rotation speed of the nozzle 104, a rotation speed of the core 103, and a required number of turns, and it may therefore be impossible to perform winding corresponding to a wire material diameter and a number of turns within specific ranges.

Moreover, in a case where a so-called self-fusing wire material, in which adjacent wire materials are fused by blowing hot air thereon, is used as the wire material 105, the wire material 105 may be fused to the wire retainers 101, 102 when the wire material is wound around a comparatively wide location of the wire retainers 101, 102 and hot air is blown thereon. In this case, the wire material 105 wound around the wire retainers 101, 102 subsequently may pass over the wire material 105 that is temporarily fused to the wire retainers 101, 102, and be guided to the core 103 first.

Hence, with the conventional winding apparatus and winding method employing the wire retainers 101, 102 formed in a tapered shape, so-called regular winding, in which the wire material 105 is wound in a successively adjacent fashion, may be difficult.

An object of the present invention is to provide a winding apparatus and a winding method with which regular winding can be performed while keeping a length of a successively wound wire material uniform regardless of an outer diameter of the wire material.

According to one aspect of the present invention, a winding apparatus is provided. The winding apparatus includes a nozzle that is adapted to rotate about a core along a locus that is inclined relative to a center line of the core, wire material winding members that are adapted to guide a wire material wound via the nozzle to the core, and a core rotating mechanism that is adapted to rotate the core relative to the wire material winding members. The wire material winding members are disposed on either side of the core so as to sandwich a plane that includes both a rotary center of the nozzle and the center line of the core, whereby the wire material winding members extend in a tangential direction to the core such that respective tip ends thereof are oriented in a rotation direction of the core. The wire material is successively wound diagonally around the core.

According to another aspect of the present invention, a winding method for successively winding a wire material diagonally around a core is provided. The winding method uses a nozzle that is adapted to rotate about the core along a locus that is inclined relative to a center line of the core, wire material winding members that are adapted to guide the wire material, which is wound via the nozzle, to the core, and a core rotating mechanism that is adapted to rotate the core relative to the wire material winding members. The wire material winding members are moved so as to extend in a tangential direction to the core on either side of the core, thereby sandwiching a plane that includes both a rotary center of the nozzle and the center line of the core. The wire material wound via the nozzle is wound around the wire material winding members and then caused to move in a circumferential direction so as to be guided to the core from respective tip ends of the wire material winding members.

DESCRIPTION OF EMBODIMENTS

An embodiment of the present invention will be described below with reference to the figures.

Figure 2:
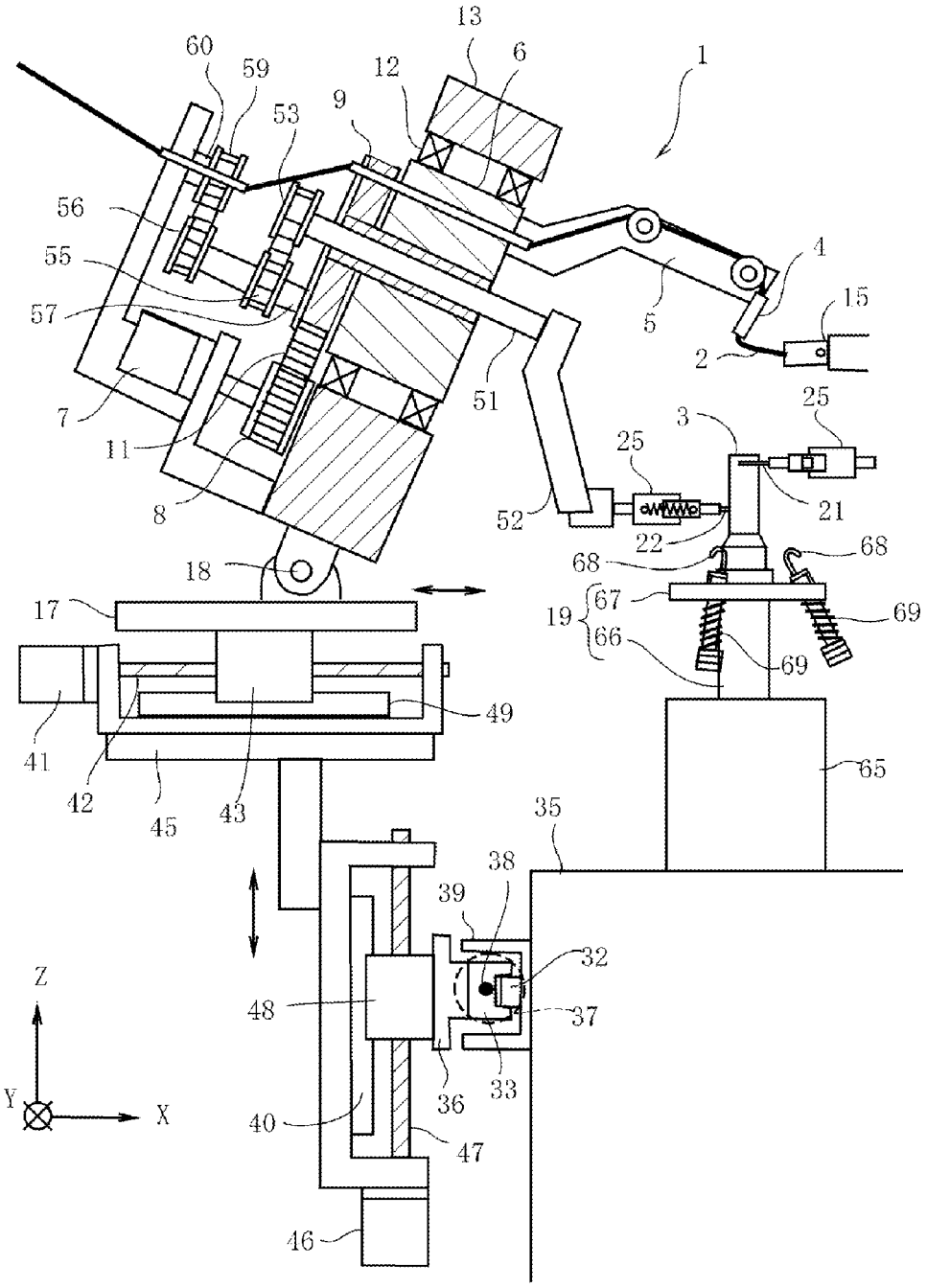
FIG. 2 is a longitudinal sectional view of the winding apparatus.
Figure 3:
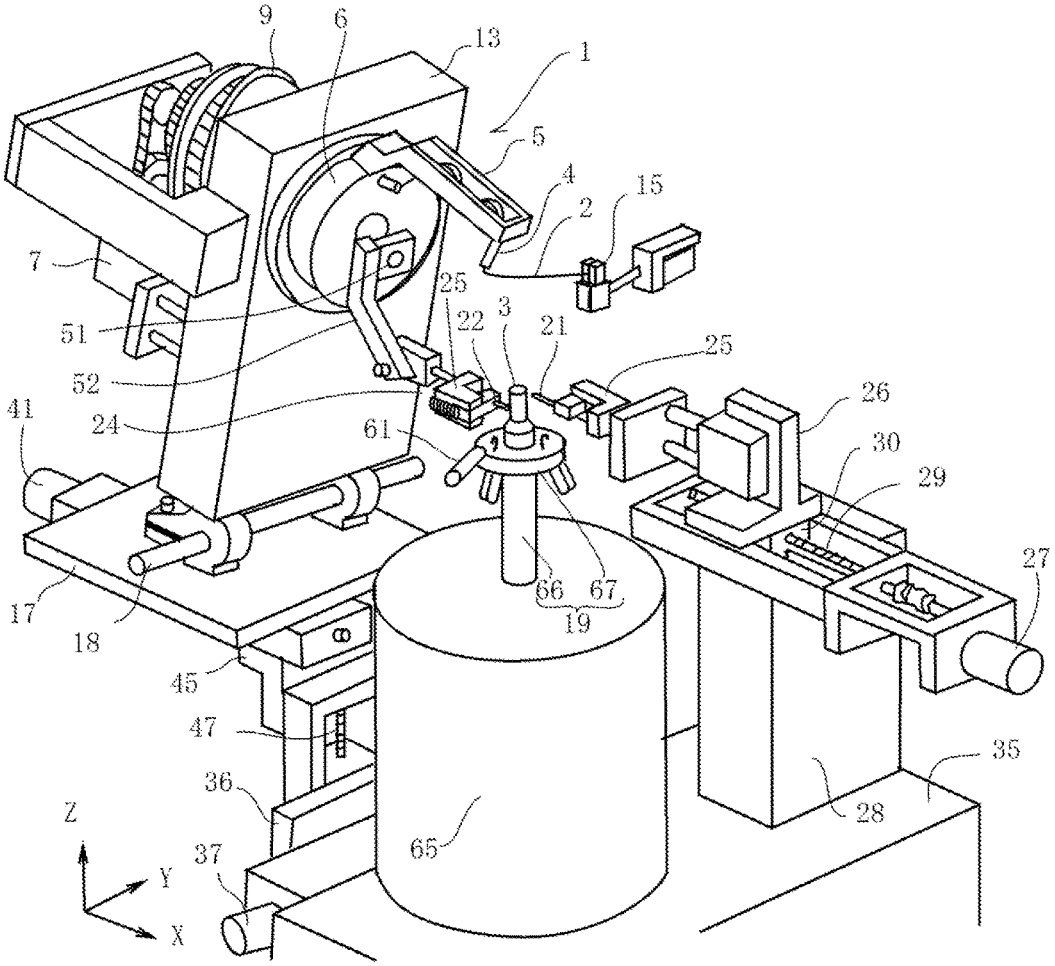
FIG. 3 is a perspective view of the winding apparatus.

As shown in FIGS. 2 and 3, a winding apparatus 1 is a flyer type winding apparatus for automatically manufacturing a coil 10 used in a rotor of a coreless motor or the like. The winding apparatus 1 includes a flyer 5 that rotates around a core 3, and a nozzle 4 that feeds a wire material 2 from a tip end of the flyer 5. By rotating the nozzle 4 diagonally about the core 3 via the flyer 5 in a condition where one end of the wire material 2 is latched to the core 3, the wire material 2 is wound diagonally around an outer periphery of the core 3.

A base end portion of the flyer 5 is coupled to a spindle 6. The spindle 6 is supported rotatably by a flyer support 13 via a bearing 12. The spindle 6 is driven to rotate by a motor 7 via pulleys 8, 9 and a belt 11.

The flyer support 13 is fixed to a left-right moving table 17 via a shaft 18. By varying an attachment angle of the shaft 18 relative to the left-right moving table 17, an angle of incline of a rotation locus through which the nozzle 4 passes can be adjusted.

The flyer support 13 moves in three axial directions, namely an X axis direction, a Y axis direction, and a Z axis direction, in accordance with a shape and a size of the coil 10 to be wound around the core 3. The flyer support 13 includes the left-right moving table 17 that moves in the X axis direction, an elevator table 45 that moves in the Z axis direction, and a front-rear moving table 36 that moves in the Y axis direction.

The left-right moving table 17 is supported to be capable of moving parallel to the elevator table 45 in the X axis direction via a guide rail 49. A ball screw 42 driven to rotate by a servo motor 41 is attached to the elevator table 45, and a nut 43 that is screwed to the ball screw 42 via a large number of balls is fixed to the left-right moving table 17.

The elevator table 45 is supported to be capable of moving parallel to the front-rear moving table 36 in the Z axis direction via a guide rail 40. A ball screw 47 driven to rotate by a servo motor 46 is attached to the elevator table 45, and a nut 48 that is screwed to the ball screw 47 via a ball is fixed to the front-rear moving table 36.

The front-rear moving table 36 is supported to be capable of moving parallel to a stand 35 in the Y axis direction via a guide rail 32. A ball screw 38 driven to rotate by a servo motor 37 is attached to a case 39 of the stand 35, and a nut 33 that is screwed to the ball screw 38 via a ball is fixed to the front-rear moving table 36.

A turntable 19 that rotates about the Z axis stands upright from a table 65 provided on the stand 35 as a core rotation mechanism that rotates the core 3 about the Z axis. The turntable 19 is driven to rotate by a servo motor, not shown in the figures, provided in the interior of the table 65. The turntable 19 is formed from a rotary shaft 66 and a disc portion 67 provided in an intermediate portion of the rotary shaft 66. The core 3 is set on an upper portion of the rotary shaft 66 of the turntable 19 so as to be detachable via a jig.

The servo motors are controlled such that every time the nozzle 4 rotates diagonally around the core 3 via the flyer 5, the core 3 rotates by a predetermined angle. The wire material 2 is thus wound diagonally and successively around the outer periphery of the core 3, and as a result, the cylindrical coil 10 is formed.

The winding apparatus 1 further includes first and second wire material winding members 21, 22 for guiding the wire material 2 wound via the nozzle 4 to the outer periphery of the core 3.

Figure 1:
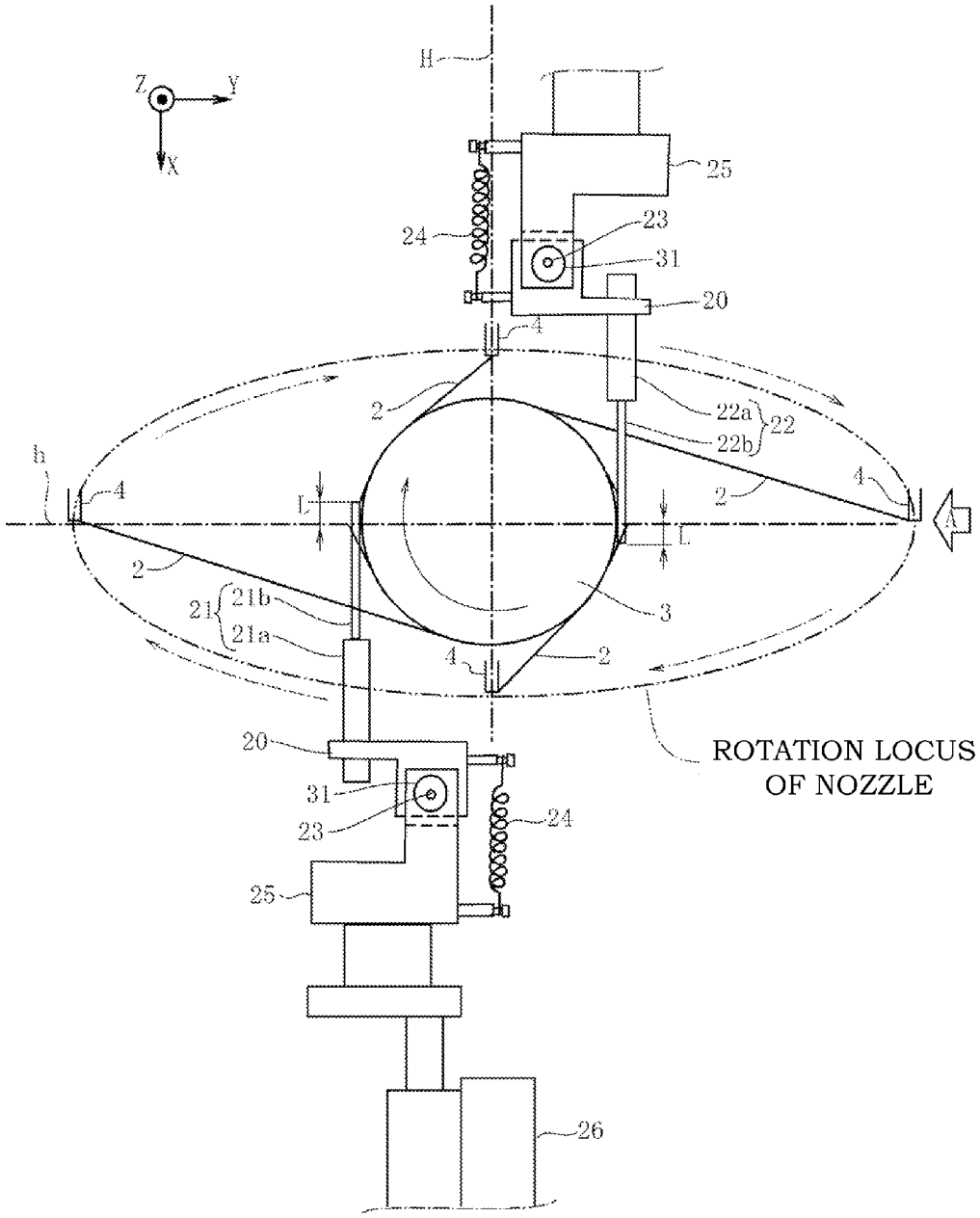
FIG. 1 is a plan view showing a relationship between a core and wire material winding members of a winding apparatus according to an embodiment of the present invention.

As shown in FIG. 1, the wire material winding members 21, 22 are positioned on either side of the core 3 so as to sandwich a plane H that includes both a rotary center of the nozzle 4 and a center line of the core 3, and are disposed on either side of the core 3 so as to oppose each other by 180 degrees. Further, as shown in FIG. 2, the first wire material winding member 21 is disposed in contact with an upper portion of the core 3, while the second wire material winding member 22 is disposed in contact with a lower portion of the core 3.

Hence, respective contact portions of the first and second wire material winding members 21, 22 contacting the core 3 are positioned on a single plane h including a rotation center line of the core 3. The plane h is orthogonal to the aforesaid plane H. When the nozzle 4 winds the wire material 2 around the outer periphery of the core 3 via the first and second wire material winding members 21, 22, the wire material 2 is guided to a predetermined position on the outer periphery of the core 3.

It should be noted that the "wire material winding members" according to the present invention function to guide the wire material, which is wound two or three times around the wire material winding members, to the core from respective tip ends thereof. As a result, an action/effect according to which the two or three wire materials wound around the wire material winding members can be kept in close contact and guided to the core after being fused to each other reliably by hot air is obtained. With the "wire retainers" used in the prior art, on the other hand, the previous wire material is retained on the tip ends until the nozzle completes a single revolution around the core such that new wire material is wound around the wire retainer. Hence, the "wire material winding members" according to the present invention are clearly different to the "wire retainers" according to the prior art in terms of configuration, functions, and actions/effects.

As shown in FIG. 1, the first and second wire material winding members 21, 22 are pin-shaped members having a circular cross-section and extending in a tangential direction to the core 3. The first and second wire material winding members 21, 22 respectively include base end side large diameter portions 21*a*, 22*a*, and tip end side small diameter pin portions 21*b*, 22*b* that are connected to and formed coaxially with the large diameter portions 21*a*, 22*a* so as to contact the core 3. The large diameter portions 21*a*, 22*a* serving as the respective base ends of the first and second wire material winding members 21, 22 are attached to a support 20 such that the small diameter pin portions 21*b*, 22*b* serving as the respective tip ends are oriented in a rotation direction of the core 3. The support 20 is supported pivotably by a bracket 25.

The winding apparatus 1 further includes a contact angle varying mechanism that is capable of varying respective contact angles at which the first and second wire material winding members 21, 22 contact the outer periphery of the core 3. The contact angle varying mechanism includes a swinging central shaft 23 that supports the first and second wire material winding members 21, 22 on the bracket 25 to be capable of swinging via a bearing 31, a spring 24 that presses the tip ends of the first and second wire material winding members 21, 22 against the core 3 by a slight biasing force, and a swinging central shaft moving mechanism for moving the swinging central shaft 23 relative to the core 3 in the X axis direction.

As shown in FIGS. 1 and 3, the winding apparatus 1 includes, as the swinging central shaft moving mechanism that moves the swinging central shaft 23 of the first wire material winding member 21 relative to the core 3 in the X axis direction, a support 26 that moves the bracket 25 in the X axis direction relative to the core 3.

As shown in FIG. 3, the support 26 is supported to be capable of moving in the X axis direction parallel to a table 28 fixed to the stand 35. More specifically, a ball screw 29 driven to rotate by a servo motor 27 is attached to the table 28, and a nut 30 that is screwed to the ball screw 29 via a ball is fixed to the support 26.

As shown in FIG. 2, the swinging central shaft moving mechanism for the second wire material winding member 22 is constituted by the left-right moving table 17 that moves the flyer support 13 in the X axis direction, a fixed shaft 51 provided to penetrate the spindle 6 of the flyer 5, a rotation latching mechanism for the fixed shaft 51, an arm 52 that couples the bracket 25 to the fixed shaft 51, and so on. The swinging central shaft 23 is moved by the swinging central shaft moving mechanism in the X axis direction together with the flyer support 13.

Positions of the swinging central shafts 23 of the first and second wire material winding members 21, 22 are varied by driving the respective servo motors 27, 41, and in so doing, movement amounts, speeds, and so on of the respective swinging central shafts 23 can be finely controlled. As a result, the first and second wire material winding members 21, 22 are capable of delicate movements.

The rotation latching mechanism, which supports the fixed shaft 51 so that the fixed shaft 51 does not rotate relative to the flyer support 13, includes a pulley 53 attached to a base end portion of the fixed shaft 51, a pulley 55 that moves in conjunction with the pulley 53 via a belt, a pulley 56 that rotates integrally with the pulley 55, a shaft 57 that supports the pulleys 55, 56 rotatably on the spindle 6, a pulley 59 that moves in conjunction with the pulley 56 via a belt, and a shaft 60 that fixes the pulley 59 coaxially with the pulley 53 of the flyer support 13. The respective pulleys 53, 55, 56, 59 are formed to have identical diameters, and therefore the fixed shaft 51 does not rotate even when the two pulleys 55, 56 rotate together with the spindle 6.

The wire material 2, which is fed from a wire material supply source, not shown in the figures, via a tensioner, is led to the nozzle 4 provided on the tip end of the flyer 5 through holes provided in the shaft 60 and the pulley 59 and a hole provided in the spindle 6. The pulleys 55, 56 and so on rotate together with the spindle 6 and therefore do not interfere with the wire material 2.

As shown in FIGS. 2, 3, and 4 to 6, meanwhile, hook rods 68 are disposed in the disc portion 67 of the turntable 19 of the core 3 as drawing means for drawing out lead wires 10*a* of the coil 10. The hook rods 68 are disposed around and below the core 3 in a number corresponding to the number of lead wires 10*a* drawn out from the coil. For example, when three slits are provided in a commutator, this means that three lead wires 10*a* are required, and therefore three hook rods 68 are disposed at predetermined intervals in a circumferential direction.

A tip end of each hook rod 68 is formed in a hook shape having a predetermined curve. A rod-shaped portion of the hook rod 68 penetrates a hole provided in the disc portion 67, and a gear 70 is attached to a lower end of the rod-shaped portion. A spring 69 that biases the hook rod 68 downward is interposed between the lower side of the disc portion 67 and the gear 70. The hook rod 68 is capable of moving up and down relative to the disc portion 67. In this embodiment, as shown in FIGS. 4 and 5, the three hook rods 68 are provided at an incline relative to the disc portion 67 so as to spread outward in a downward radial direction.

Figure 4:
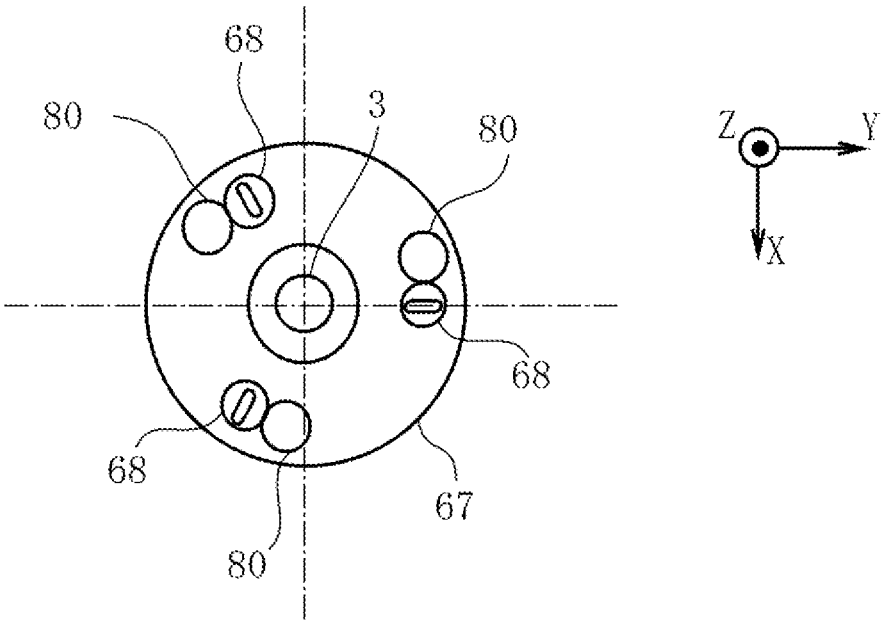
FIG. 4 is a plan view showing an arrangement of hook rods.
Figure 6:
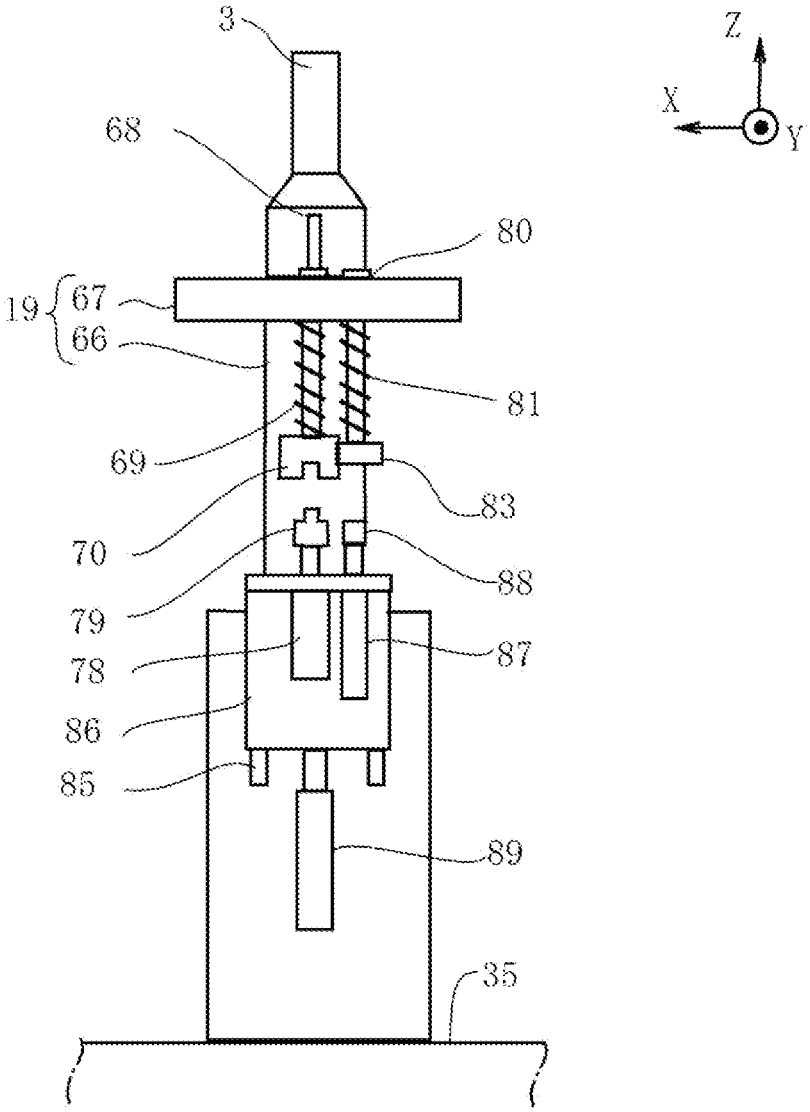
FIG. 6 is a view showing rotation restricting means.
Figure 7:
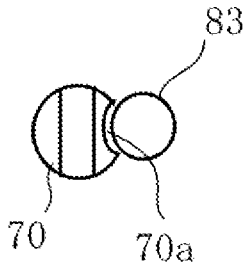
FIG. 7 is a view showing a rotation restriction condition.

As shown in FIGS. 4 and 6, lock rods 80 are provided in the disc portion 67 of the turntable 19 alongside the hook rods 68 to be capable of sliding. Each lock rod 80 has a rotation restricting member 83 on a lower end thereof, and is maintained in a descended condition by a biasing force of a spring 81 interposed between the lower side of the disc portion 67 and the rotation restricting member 83. As shown in FIG. 7, when the lock rod 80 is in the descended condition, the rotation restricting member 83 engages with a recessed portion 70*a* provided in an outer periphery of the gear 70, and as a result, rotation of the hook rod 68 is restricted. The lock rod 80, the spring 81, and the rotation restricting member 83 together constitute rotation restricting means.

Figure 5:
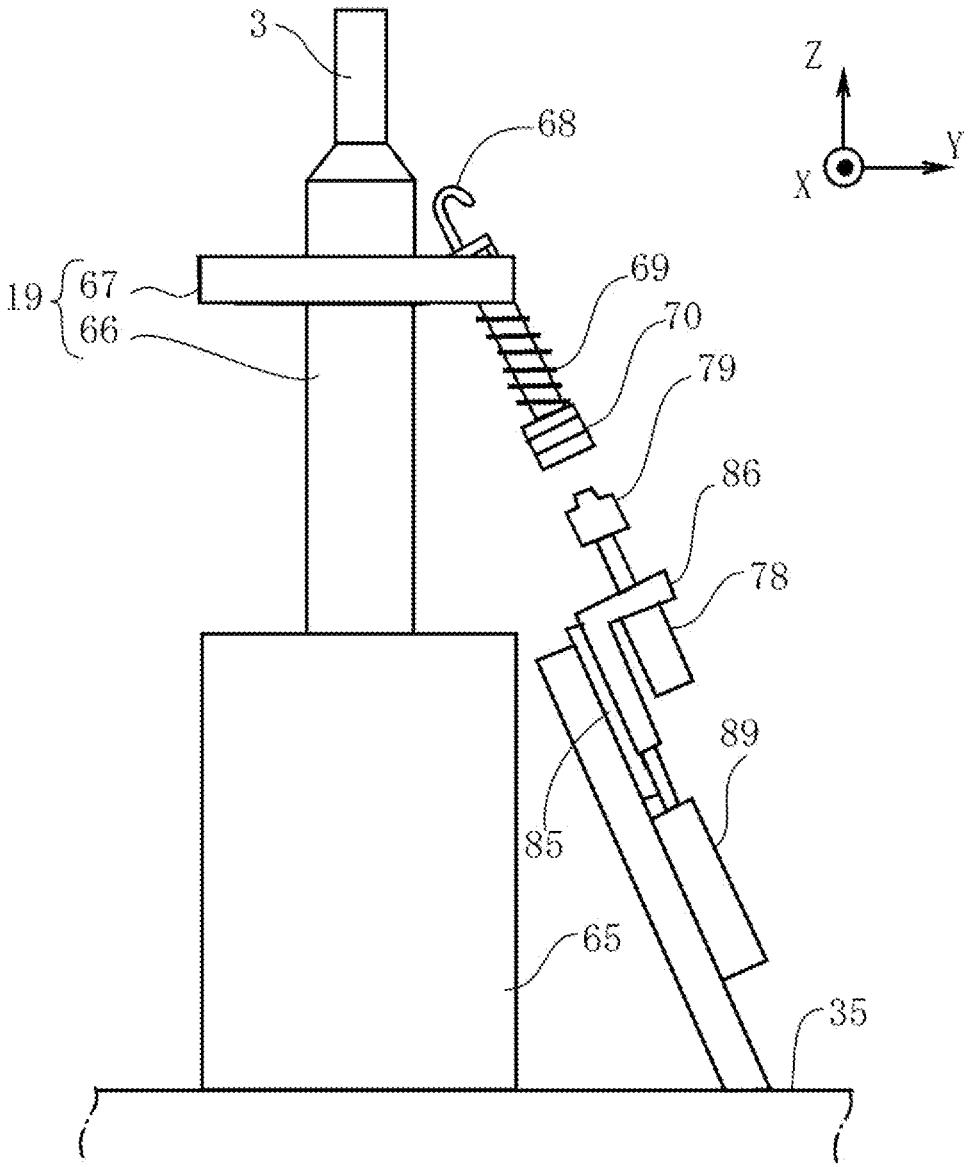
FIG. 5 is a side view of a turntable.

As shown in FIGS. 5 and 6, a tap moving table 86 that is displaced along an extension line of the hook rod 68 and the lock rod 80 via a rail 85 is provided on the stand 35 as means for moving the hook rod 68 and the lock rod 80. The tap moving table 86 is driven by an air cylinder 89.

As shown in FIG. 6, a gear 79 driven to rotate by a servo motor 78 and a lock releasing rod 88 that pushes the lock rod 80 upward using an air cylinder 87 are attached to the tap moving table 86.

To draw out the lead wire 10*a* of the coil 10, the hook rod 68 and the lock rod 80 are positioned on respective extension lines of the gear 79 and the lock releasing rod 88, and in this condition, the air cylinder 89 is caused to expand by a predetermined large stroke such that the tap moving table 86 is moved upward. As the tap moving table 86 moves, the gear 79 contacts the gear 70, whereby the hook rod 68 is pushed upward from a preset initial position to a hooking position for hooking the wire material.

When the air cylinder 89 is caused to contract with the hook rod 68 in the hooking position, the tap moving table 86 moves downward such that the gear 79 separates from the gear 70, and as a result, the hook rod 68 is pushed down to the initial position by the biasing force of the spring 69. When, at this time, the wire material 2 catches on an upper end of the hook rod 68, new wire material 2 is drawn out of the nozzle 4 so as to form the lead wire 10*a*.

At this time, the lock rod 80 moves up and down together with the hook rod 68. The rotation restricting member 83 is maintained in an engaged condition with the recessed portion 70*a* of the gear 70, and therefore rotation of the hook rod 68 is prohibited.

Further, the tap moving table 86 is provided with twisting means for twisting the lead wire 10*a* drawn out by the hook rod 68. The twisting means is constituted by the servo motor 78 attached to the tap moving table 86, and the gear 79 attached to the shaft of the servo motor 78.

To twist the drawn lead wire 10*a*, the air cylinder 89 is caused to expand by a predetermined small stroke that is smaller than the stroke used to draw out the lead wire 10*a*, whereby the tap moving table 86 is moved upward. At this time, although the gear 79 remains meshed to the gear 70, the hook rod 68 is not pushed upward.

When the air cylinder 87 is caused to expand in this condition, the lock releasing rod 88 pushes the lock rod 80 upward such that the rotation restriction on the hook rod 68 is released. When, in this condition, the servo motor 78 is caused to rotate by a preset number of turns determined in advance, the rotation is transmitted to the hook rod 68 via the gears 79, 70, causing the hook rod 68 to rotate, and as a result, the lead wire 10*a* is twisted.

When twisting is complete, the air cylinder 87 is caused to contract such that the lock rod 80 moves downward and rotation of the hook rod 68 is again restricted.

The winding apparatus 1 further includes a clamp mechanism 15 capable of gripping the wire material 2 drawn out from the tip end of the nozzle 4, a moving apparatus, not shown in the figures, that moves the clamp mechanism 15 in the three axial directions, and a duct 61 that blows hot air toward the core 3.

A surface of the wire material 2 is coated with an adhesive layer. The adhesive layer is melted by the hot air supplied from the duct 61 such that when the melted adhesive layer hardens, adjacent wire materials 2 wound around the core 3 are fused together.

Next, a winding method employing the winding apparatus 1 will be described.

In the winding method according to this embodiment, as shown in FIG. 1, the wire material winding members 21, 22 are moved so as to extend in the tangential direction to the core 3 on either side of the core 3, thereby sandwiching the plane H that includes both the rotary center of the nozzle 4 and the center line of the core 3. Next, the wire material 2 wound via the nozzle 4 is wound around the wire material winding members 21, 22 and then moved in the circumferential direction so as to be guided to the core 3 from the respective tip ends of the wire material winding members 21, 22. Specific procedures of the winding method will be described below.

First, in the winding apparatus 1, the wire material 2 is drawn out from the tip end of the nozzle 4 and latched to the clamp mechanism 15. Meanwhile, the core 3 is attached to the turntable 19 via the jig, whereupon a start button of a controller, not shown in the figures, is pressed.

After tying the wire material 2 around the hook-shaped portion of the hook rod 68, the support 26 and the flyer 5 are brought close to the core 3 and, as shown in FIG. 1, the first and second wire material winding members 21, 22 are moved so as to extend in the tangential direction to the core 3 on either side of the core 3, thereby sandwiching the plane H that includes both the rotary center of the nozzle 4 and the center line of the core 3. The first and second wire material winding members 21, 22 are then pushed against the core 3 by the slight biasing force.

At this time, a length L from respective points of the first and second wire material winding members 21, 22 that contact or most closely approach the outer periphery of the core 3 to the tip ends thereof is set between 1.5 and 3 times the diameter of the wire material 2. The nozzle 4 is then rotated diagonally about the core 3 via the flyer 5 such that the wire material 2 is wound around the core 3.

Next, an operation for winding the wire material 2 around the core 3 will be described on the basis of FIGS. 8 to 10.

Figure 8:
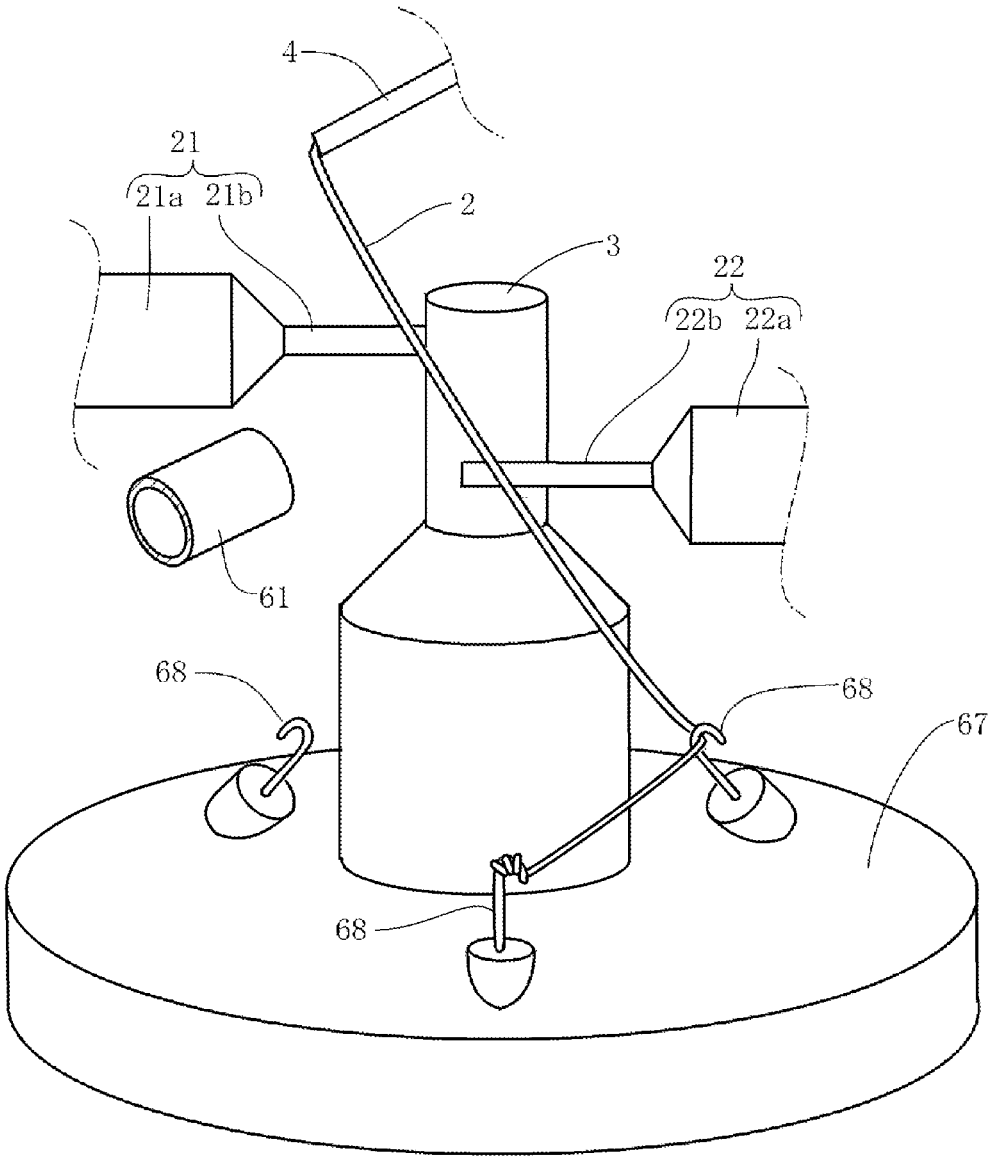
FIG. 8 is a view seen from an A direction of FIG. 1, showing the start of a process for winding a wire material around a core.

As shown in FIG. 8, a case in which three hook rods 68 penetrate the disc portion 67 diagonally in order to form three lead wires 10*a* will be described.

The wire material 2 is tied around the hook-shaped portion of the hook rod 68 positioned at a winding start point, then wound around the hook-shaped portion of the hook rod 68 positioned rearward in the rotation direction of the core 3, and then guided to the core 3. By guiding the wire material 2 to the core 3 after winding the wire material 2 around the hook rod 68 positioned rearward in the rotation direction in this manner, the wire material 2 can be guided to the core 3 above the hook rod 68 positioned at the winding start point.

The nozzle 4 is then rotated diagonally around the core 3 via the flyer 5 such that the wire material 2 is wound around the core 3 via the first and second wire material winding members 21, 22.

In this embodiment, as shown in FIG. 1, the wire material winding members 21, 22 are provided on either side of the core 3 so as to sandwich the plane H that includes both the rotary center of the nozzle 4 and the center line of the core 3, and therefore the wire material 2 fed from the nozzle 4 contacts the wire material winding members 21, 22 when the nozzle 4 reaches a position comparatively removed from the plane H. When the nozzle 4 returns to the plane H, the wire material fed from the nozzle is wound around the wire material winding members 21, 22.

Figure 9:
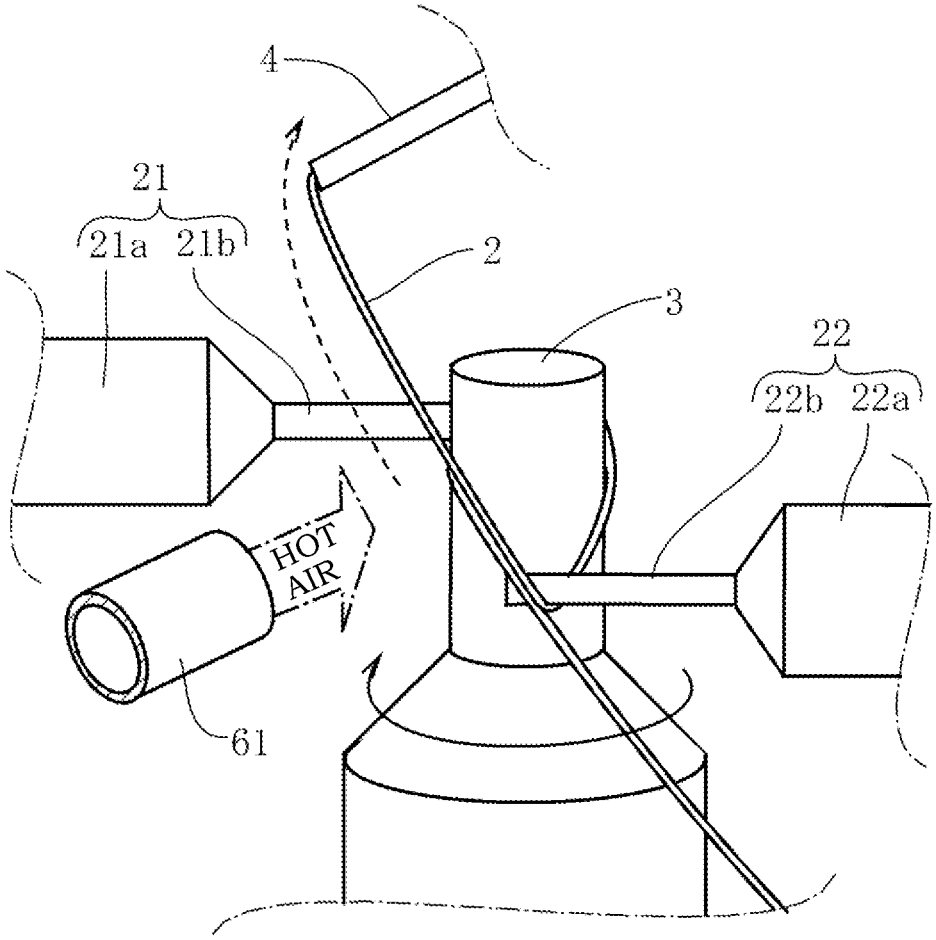
FIG. 9 is a view showing a condition in which the wire material has been wound once around the core.

As shown in FIG. 9, therefore, when the nozzle 4 performs an initial single revolution around the core 3, the wire material 2 fed from the nozzle 4 is wound around the first and second wire material winding members 21, 22 and moves so as to slide along the respective surfaces of the wire material winding members 21, 22.

Further, every time the nozzle 4 performs a single revolution around the core 3, the core 3 rotates by a predetermined angle corresponding to the outer diameter of the wire material 2 via the turntable 19.

Figure 10:
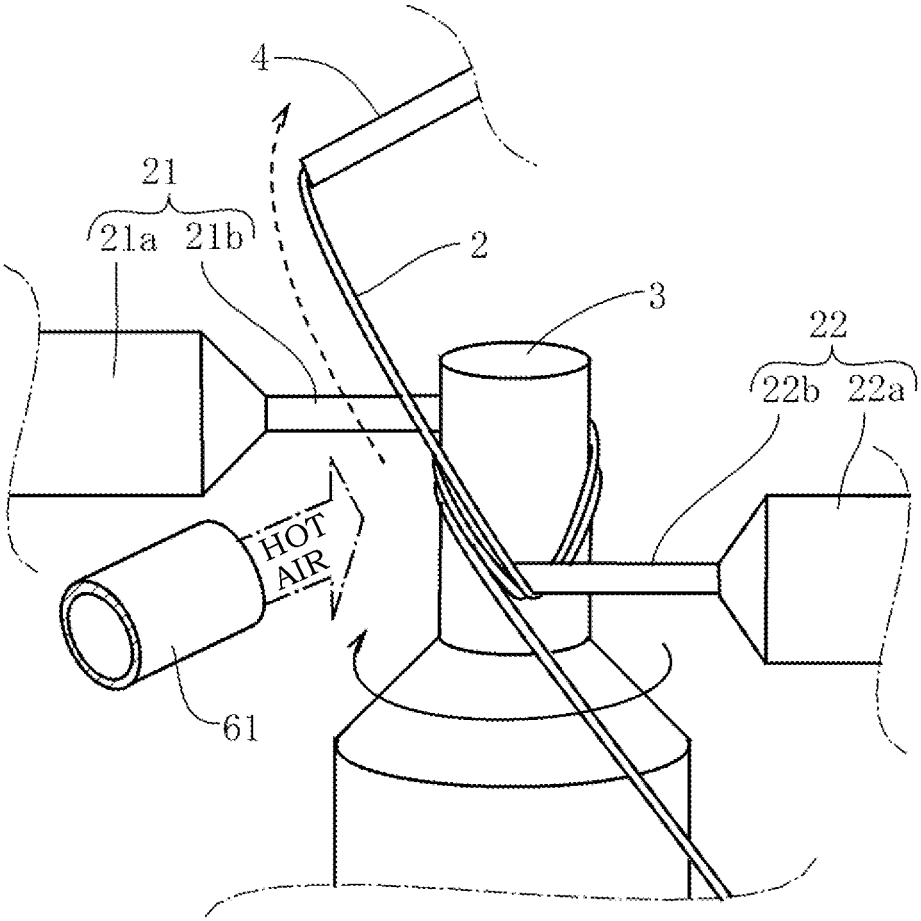
FIG. 10 is a view corresponding to FIG. 9, showing a condition in which the wire material has been wound twice around the core.

Hence, as shown in FIG. 10, when the nozzle 4 performs another revolution around the core 3, the wire material 2 wound around the core 3 also moves in the circumferential direction of the core 3 by an amount corresponding to the outer diameter of the wire material 2, while the wire material 2 wound around the first and second wire material winding members 21, 22 moves toward the respective tip ends of the first and second wire material winding members 21, 22 by an amount corresponding to the outer diameter of the wire material 2.

The new wire material 2 fed out from the nozzle 4 is then wound around the first and second wire material winding members 21, 22, whereupon this wire material 2 moves so as to slide along the respective surfaces of the wire material winding members 21, 22 until it becomes adjacent to the initially wound wire material 2 that has moved to the respective tip ends of the first and second wire material winding members 21, 22.

At this time, the first and second wire material winding members 21, 22 are caused to swing in a direction passing over the wire material 2 wound around the core 3, or in other words a radially outward direction, by the spring 24 of the contact angle varying mechanism, and therefore the movement of the wire material 2 wound around the first and second wire material winding members 21, 22 is not obstructed by the first and second wire material winding members 21, 22.

By rotating the core 3 in the direction of a solid line arrow, the wire material 2 wound around the first and second wire material winding members 21, 22 moves in the tip end direction of the first and second wire material winding members 21, 22. Further, by simultaneously rotating the nozzle 4 diagonally about the core 3 in the direction of a dotted line arrow, new wire material is wound around the first and second wire material winding members 21, 22 in locations from which the initially wound wire material 2 has moved in the tip end direction of the first and second wire material winding members 21, 22. As a result, the newly wound wire material 2 is arranged so as to contact the wire material 2 already wound around the first and second wire material winding members 21, 22 without gaps. Hot air supplied from the duct 61 is then blown against the wire material 2 wound tightly around the core 3 between the first and second wire material winding members 21, 22 such that the adhesive layer applied to the surface of the wire material 2 melts, and as a result, the adjacent wire materials 2 are fused together.

Furthermore, by rotating the nozzle 4 diagonally about the core 3 in the direction of the dotted line arrow and simultaneously rotating the core 3 in the direction of the solid line arrow, the wire materials 2 wound successively around the first and second wire material winding members 21, 22 move successively in the tip end direction of the first and second wire material winding members 21, 22, and after separating from the tip ends, are guided to the outer surface of the core 3.

Here, pin-shaped members having identically shaped cross-sections are used as the wire material winding members 21, 22, and therefore a length by which the wire material 2 is wound around the wire material winding members 21, 22 remains constant regardless of the winding position.

Hence, the length of the wire material 2 guided to and wound successively around the core 3 does not vary even in different axial direction winding positions of the wire material winding members 21, 22.

The wire material 2 fed out from the nozzle 4 is initially wound around the wire material winding members 21, 22, and is then guided to the core 3 after slipping off the respective tip ends of the wire material winding members 21, 22. Even when the outer diameter of the wire material 2 is comparatively large, therefore, the wire material 2 is guided to the core 3 after being wound around the wire material winding members 21, 22. As a result, even a comparatively thick wire material can be wound appropriately.

A difference in the outer diameter of the wire material 2 can be dealt with simply by modifying a rotation speed of the core 3, and since a rotation speed of the nozzle 4, the rotation speed of the core 3, and the number of turns can be set comparatively freely, winding can be performed in accordance with desired specifications of the coil 10.

Further, by adjusting an interval between the upper first wire material winding member 21 and the lower second wire material winding member 22 positioned above and below the core 3, a length of the coil 10 in the axial direction of the core 3 can be set accurately and easily.

Furthermore, in a case where the wire material winding members 21, 22 are pin-shaped members having a circular cross-section, a length by which the wire material 2 contacts the wire material winding members 21, 22 corresponds to a length of a semicircular arc of the cross-section, and therefore, even when a self-fusing wire material is used as the wire material 2, the wire material 2 is not fused to the wire material winding members 21, 22 by the hot air.

Accordingly, the wire material 2 subsequently wound around the wire material winding members 21, 22 does not pass over the initially wound wire material 2. The wire material 2 wound successively around the wire material winding members 21, 22 as the nozzle 4 rotates is guided successively to the core 3 in a side-by-side arrangement, and as a result, so-called regular winding, in which the wire material 2 is wound in a successively adjacent fashion, can be achieved regardless of the thickness of the wire material 2.

Here, the wire materials 2 wound around the core 3 between the first and second wire material winding members 21, 22 are in close contact with each other, and therefore, when a large amount of time is taken to guide the wire material 2 to the core, the wire materials 2 in close contact with each other can be fused together more reliably by the hot air.

Furthermore, the length L from the respective points of the first and second wire material winding members 21, 22, constituted by pin-shaped members, that contact or most closely approach the outer periphery of the core 3 to the tip ends thereof is set between 1.5 and 3 times the diameter of the wire material 2. Therefore, the wire material 2 wound successively around the first and second wire material winding members 21, 22 is guided to the core 3 from the tip ends after being wound two or three times around the first and second wire material winding members 21, 22.

Hence, the time required to guide the wire material 2 to the core 3 after being wound around the wire material winding members 21, 22 is comparatively long, and therefore regular winding can be achieved while keeping the length of the successively wound wire material 2 uniform.

By rotating the nozzle 4 a predetermined number of turns such that the wire material 2 is wound around a part of the outer periphery of the core 3, for example a third of the outer periphery, the lead wires 10*a* are drawn out and twisted.

Next, drawing and twisting of the lead wire 10*a* will be described on the basis of FIGS. 11 and 12.

First, as shown in FIGS. 5 and 6, when the wire material 2 has been wound by a predetermined number of windings, the hook rod 68 and the lock rod 80 are positioned on the respective extension lines of the gear 79 and the lock releasing rod 88. The air cylinder 89 is then caused to expand by a predetermined large stroke such that the tap moving table 86 is moved upward, whereby the hook rod 68 is pushed upward from the preset initial position to the hooking position for hooking the wire material 2, as shown by a dotted line in FIG. 11. In other words, the hook rod 68 positioned in a winding end part of the wire material 2 is lifted to a position adjacent to the wire material winding member 22.

As shown in FIG. 8, the winding start part of the wire material 2 is hooked onto the hook rod 68 in advance. Therefore, after lifting the hook rod 68, the hook rod 68 is rotated once so that the hooked wire material 2 is detached from the hook rod 68.

In this condition, the nozzle 4 is rotated diagonally around the core 3 via the flyer 5 such that the fed wire material 2 is hooked onto the hook-shaped portion of the hook rod 68.

The hook rod 68 is then pushed down to an initial position indicated by a solid line. When the hook rod 68 is lowered to the initial position, the wire material 2 is drawn out by a length corresponding to the lowered hook rod 68, thereby forming the lead wire 10*a*.

Figure 12:
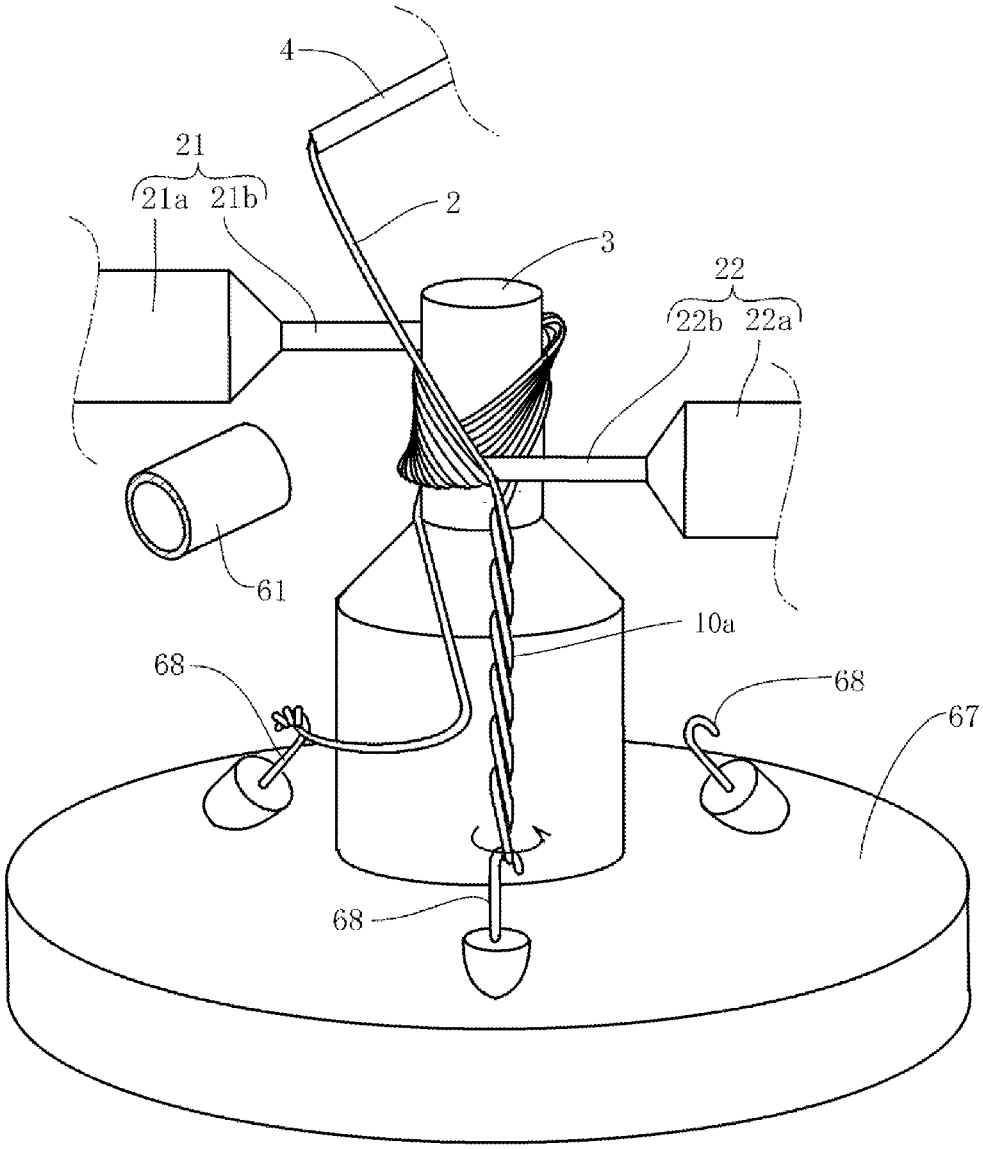
FIG. 12 is a view corresponding to FIG. 8, showing a condition in which a lead wire is formed.

Next, as shown in FIG. 12, the servo motor 78 is rotated a predetermined number of times while maintaining a condition in which the lock rod 80 is moved upward by the air cylinder 87, and as a result, the lead wire 10*a* drawn out by the hook rod 68 is twisted a predetermined number of turns. When an upper end portion of the twisted lead wire 10*a* reaches the vicinity of the wire material winding member 22, the twisting operation is terminated.

When the predetermined twisting operation is complete, the rotation restricting member 83 is engaged with the recessed portion 70*a* of the gear 70, as shown in FIG. 7, whereby rotation of the hook rod 68 is prohibited.

The wire material 2 fed out from the nozzle 4 is then latched to the wire material winding members 21, 22 and wound around the core 3 in order to proceed with the next winding.

Every time the wire material 2 is wound, the core 3 rotates via the turntable 19, and the hook rod 68 that draws out the lead wire 10*a*, as well as the other hook rods 68, likewise rotates together with the turntable 19.

Figure 11:
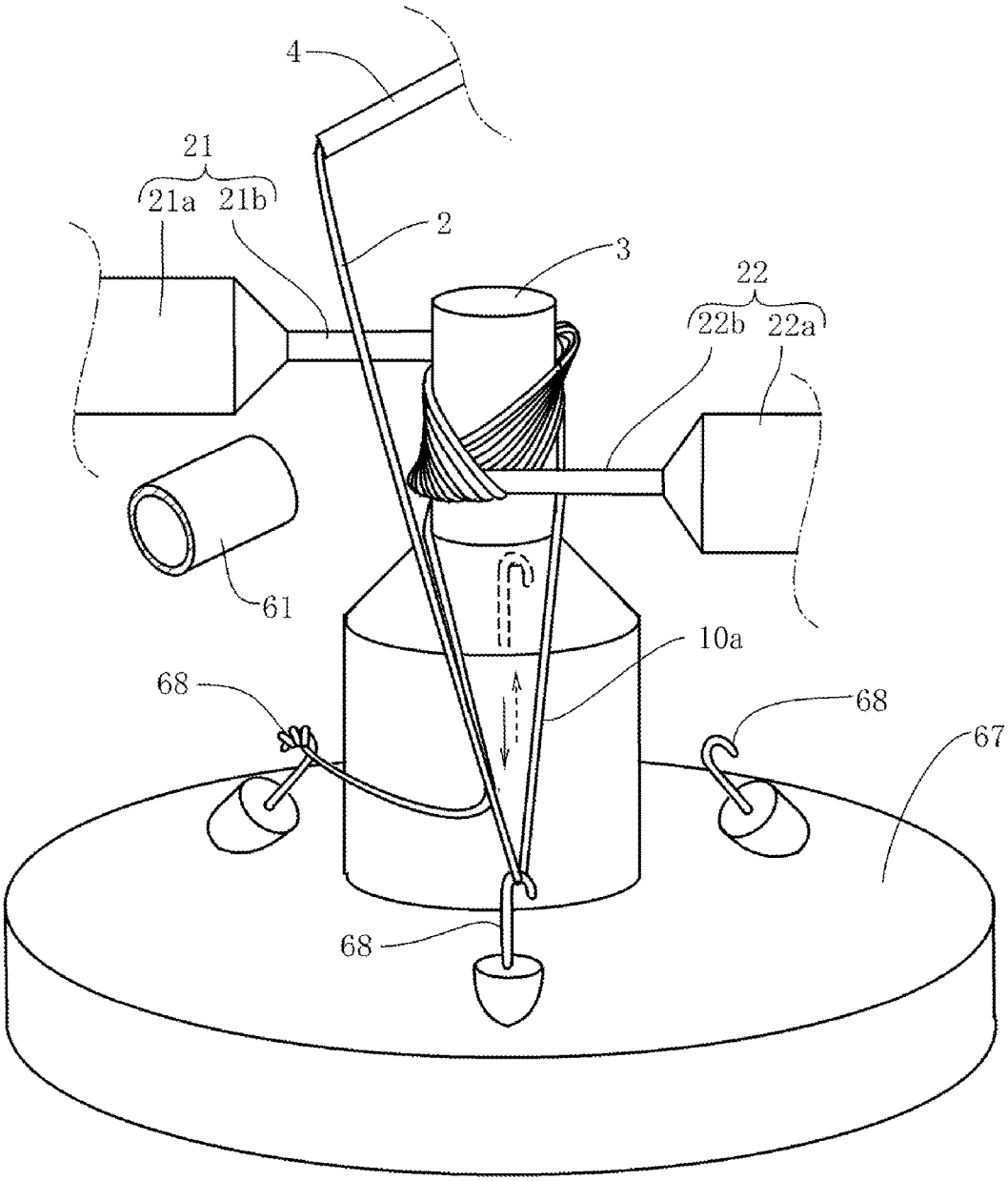
FIG. 11 is a view corresponding to FIG. 8, showing a condition in which the wire material has been wound around a third of an outer periphery of the core.

Once winding has been performed successively in this manner up to an angle at which the next lead wire 10*a* is to be drawn, the next hook rod 68 is lifted, whereupon similar operations to those shown in FIGS. 11 and 12 are performed in order to twist the wire material 2 drawn out by the hook rod 68 again and form the next lead wire 10*a*.

Figure 13:
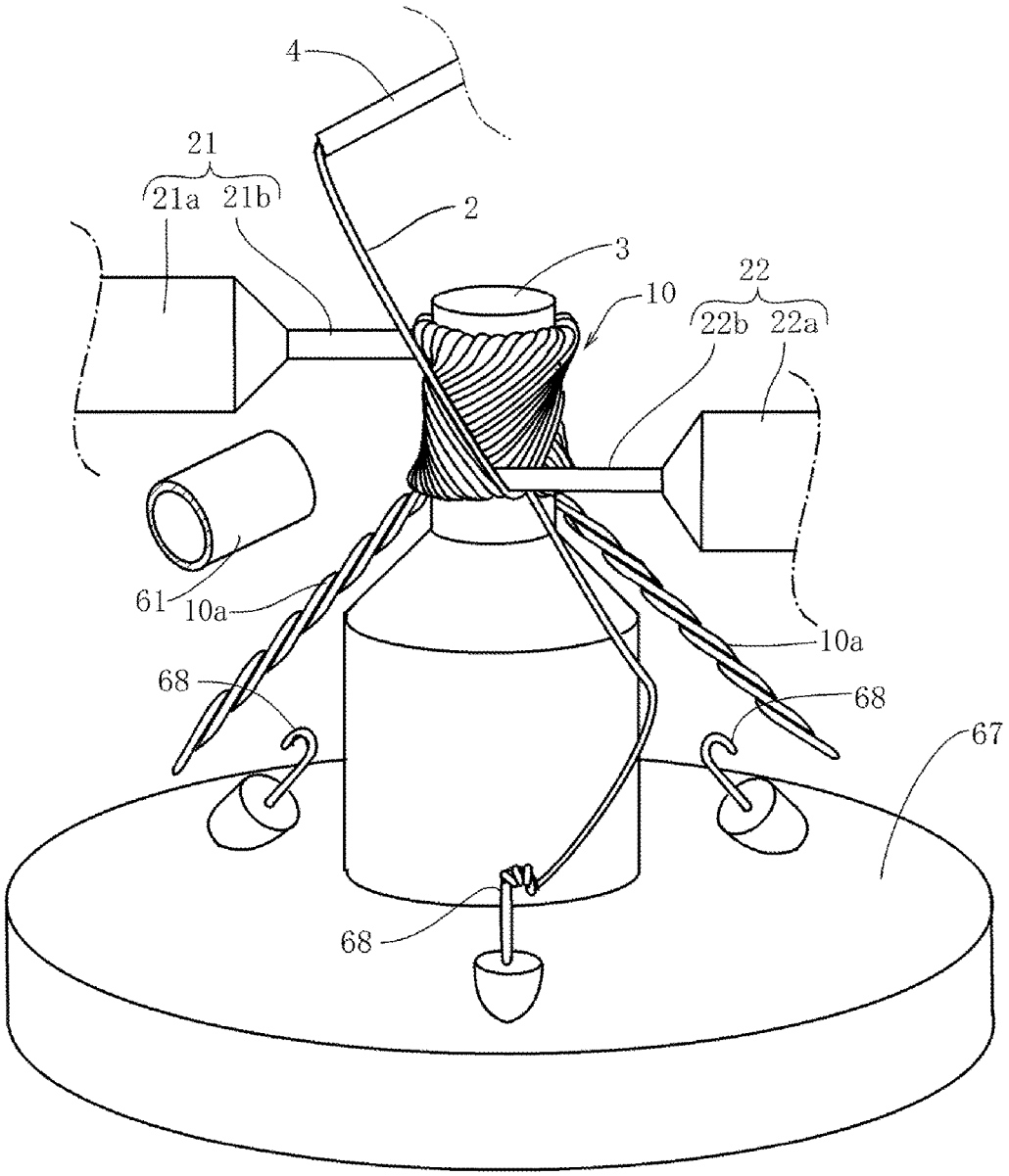
FIG. 13 is a view corresponding to FIG. 8, showing a condition in which the wire material has been wound around the entire outer periphery of the core.

When drawing of the lead wires 10*a*, twisting of the lead wires 10*a*, and winding of the wire material 2 have been performed a predetermined number of times in the manner described above, the coil 10 formed by winding the wire material 2 around the entire periphery of the core 3, as shown in FIG. 13, is obtained.

Figure 14:
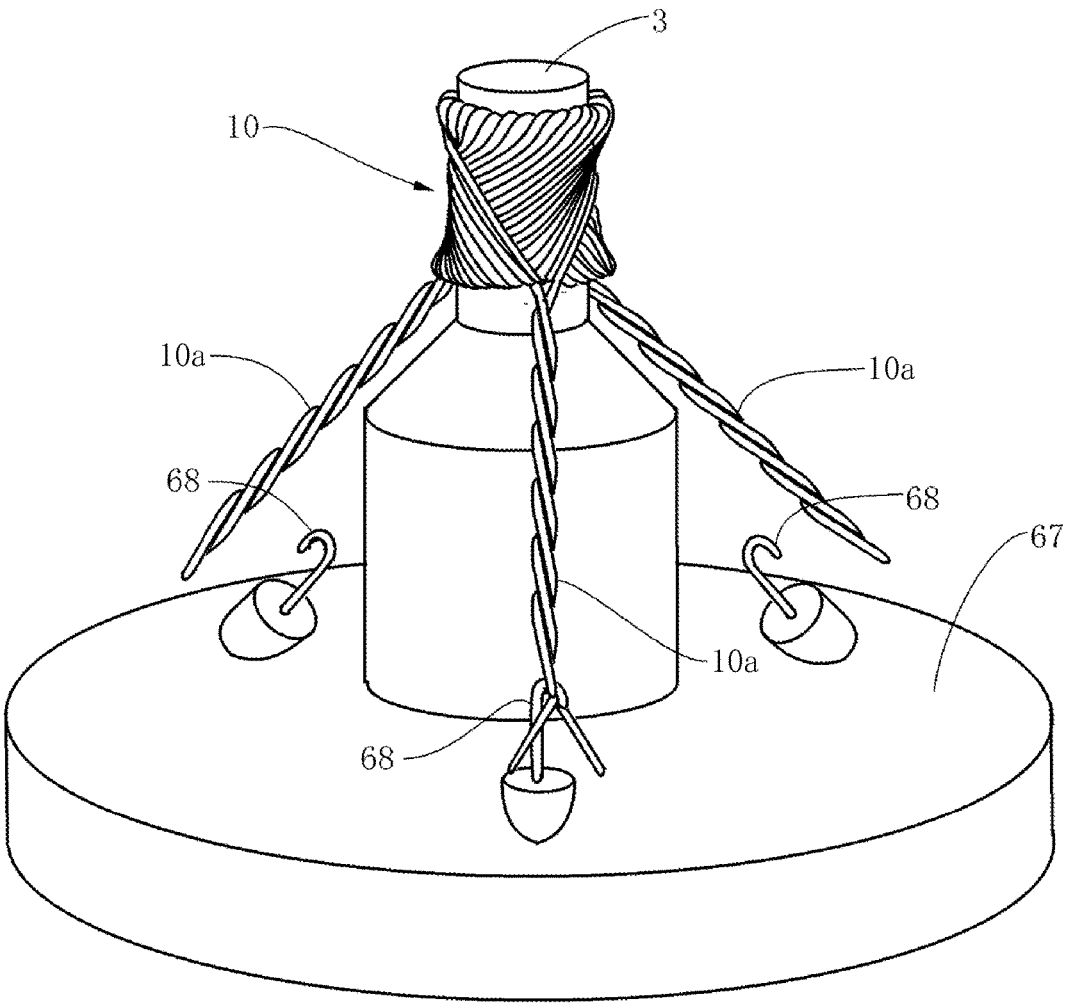
FIG. 14 is a view corresponding to FIG. 8, showing a condition in which all lead wires are formed.
Figure 15:
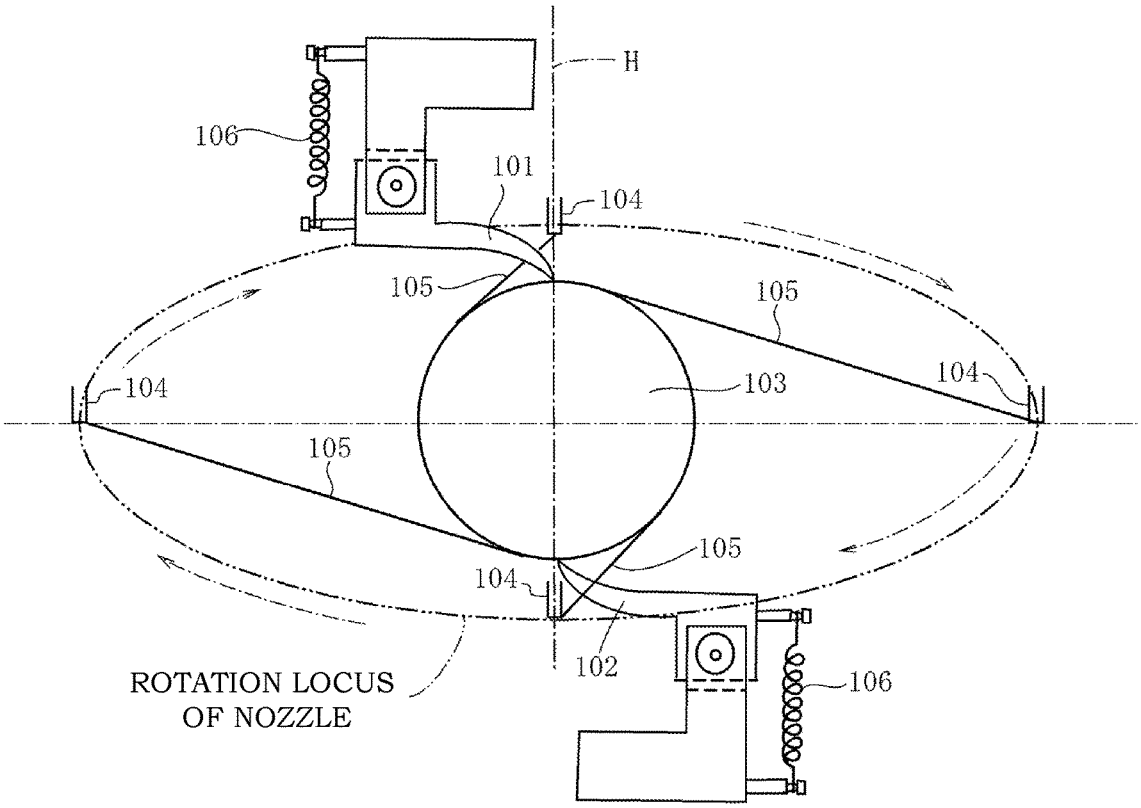
FIG. 15 PRIOR ART
FIG. 15 is a view corresponding to FIG. 1, showing a relationship between a core and wire retainers in a conventional winding apparatus.

Once the coil 10 has been obtained, the wire material winding members 21, 22 are removed from the coil 10, whereupon the wire material 2 at the winding end point is tied to the hook rod 68 to which the wire material 2 was initially tied, and twisted, as shown in FIG. 14. The wire material 2 fed out from the nozzle 4 at the tip end of the flyer 5 is then latched to the clamp mechanism 15, whereupon the wire material 2 is cut between the hook rod 68 and the clamp mechanism 15. Coil winding is thus completed.

It should be noted that in order to remove the twisted lead wire 10*a* from the hook rod 68, the hook rod 68 may be rotated while raised so that the lead wire 10*a* is removed from the hook rod 68.

Hence, using drawing means for drawing out the lead wires 10*a* of the coil and twisting means for twisting the drawn lead wires 10*a*, drawing and twisting of the lead wires 10*a* can be performed automatically.

Further, since the lead wires 10*a* are drawn and twisted automatically, situations in which the wire material unravels from a base end portion of the lead wire 10*a*, variation occurs in an amount of twisting, insufficient twisting is performed so that the wire material 2 shifts before being soldered, or excessive twisting is performed so that the wire material breaks can be avoided. Therefore, in comparison with a manual operation, the lead wires 10*a* can be formed easily and appropriately.

Pin-shaped members having identically shaped cross-sections are used as the wire material winding members 21, 22, and since this type of pin-shaped member is a commercially available, general purpose component, the wire material winding members 21, 22 can be obtained inexpensively. Further, since the pin-shaped member is a general purpose component, the surface thereof is finished to a constant, smooth surface roughness, and little dimensional variation occurs therein. As a result, the surface of the wire material 2 that is guided to the core 3 by being caused to slide along the surfaces of the wire material winding members 21, 22 is not damaged.

Moreover, the wire material winding members 21, 22 are pin-shaped members constituted by the large diameter portions 21*a*, 22*a* and the small diameter pin portions 21*b*, 22*b* connected to and formed coaxially with the large diameter portions 21*a*, 22*a*. Therefore, by setting a length of the small diameter pin portions 21*b*, 22*b* around which the wire material 2 is wound at a length required to wind the wire material 2 and using a remaining part as the large diameter portions 21*a*, 22*a*, an improvement in strength can be obtained, and the wire material 2 can be wound sufficiently even when comparatively thick.

It should be noted that in the embodiment described above, a case in which the parts of the wire material winding members 21, 22 around which the wire material 2 is wound have a circular cross-section was described, but the cross-section may be elliptical. In this case, when a long axis of the ellipse is set to be parallel to the center line of the core 3, the wire material is wound around the wire material winding members 21, 22 so as to have a comparatively small radius of curvature. The coil 10 is press-molded thereafter, but in this case, the wire material 2 is already wound at a small radius of curvature, and therefore press-molding can be performed more easily. As a result, variation in an axial direction length of the obtained coil 10 can be reduced.

Embodiments of the present invention were described above, but the above embodiments are merely examples of applications of the present invention, and the technical scope of the present invention is not limited to the specific constitutions of the above embodiments.

This application claims priority based on Japanese Patent Application No. 2013-270995 filed with the Japan Patent Office on Dec. 27, 2013, the entire contents of which are incorporated into this specification.

The invention claimed is:

1. A winding apparatus comprising:

a nozzle that is adapted to rotate about a core along a locus that is inclined relative to a center line of the core;

wire material winding members that are adapted to guide a wire material wound via the nozzle to the core; and a core rotating mechanism that is adapted to rotate the core relative to the wire material winding members, wherein the wire material winding members are disposed on either side of the core so as to sandwich a plane that includes both a rotary center of the nozzle and the center line of the core, whereby the wire material winding members extend in a tangential direction to the core such that respective tip ends thereof are oriented in a rotation direction of the core, and the wire material is successively wound diagonally around the core.

2. The winding apparatus as defined in claim 1, wherein a length from respective points of the wire material winding members that contact or most closely approach an outer periphery of the core to the tip ends thereof is set between 1.5 and 3 times a diameter of the wire material.

3. The winding apparatus as defined in claim 1, wherein the wire material winding members are pin-shaped members having a circular or elliptical cross-section.

4. The winding apparatus as defined in claim 1, wherein the tip ends of the wire material winding members have a different diameter to respective base ends thereof such that the diameter of the base ends is larger than the diameter of the tip ends.

5. A winding method for successively winding a wire material diagonally around a core using:

a nozzle that is adapted to rotate about the core along a locus that is inclined relative to a center line of the core;

wire material winding members that are adapted to guide the wire material, which is wound via the nozzle, to the core; and a core rotating mechanism that is adapted to rotate the core relative to the wire material winding members, wherein the wire material winding members are moved so as to extend in a tangential direction to the core on either side of the core, thereby sandwiching a plane that includes both a rotary center of the nozzle and the center line of the core, and the wire material wound via the nozzle is wound around the wire material winding members and then caused to move in a circumferential direction so as to be guided to the core from respective tip ends of the wire material winding members.

6. The winding method as defined in claim 5, wherein a length from respective points of the wire material winding members that contact or most closely approach an outer periphery of the core to the tip ends thereof is set between 1.5 and 3 times a diameter of the wire material, and the wire material is guided to the core from the respective tip ends of the wire material winding members after being wound two to three times around the wire material winding members.

* * * * *